United States Patent [19]

Oki et al.

[11] Patent Number: 4,976,130

[45] Date of Patent: Dec. 11, 1990

[54] EXTRUDING DIE FOR METALLIC MATERIALS

[75] Inventors: Yoshinari Oki; Takeshi Tanaka; Ryoji Tuno, all of Takaoka; Yoshihiro Yoshida, Shinminato, all of Japan

[73] Assignee: Sankyo Aluminum Industry Company Limited, Toyama, Japan

[21] Appl. No.: 429,598

[22] Filed: Oct. 31, 1989

[30] Foreign Application Priority Data

Jan. 13, 1989 [JP] Japan ..... 1-7293
Mar. 8, 1989 [JP] Japan ..... 1-55922

[51] Int. Cl.[5] ..... B21C 25/04
[52] U.S. Cl. ..... 72/269
[58] Field of Search ..... 72/269

[56] References Cited

U.S. PATENT DOCUMENTS

| | | | |
|---|---|---|---|
| 715,358 | 12/1902 | Dick | 72/269 |
| 3,748,885 | 7/1973 | Creuzet | 72/269 |
| 4,598,567 | 7/1986 | Backus | 72/269 |

FOREIGN PATENT DOCUMENTS

| | | | |
|---|---|---|---|
| 668737 | 6/1979 | U.S.S.R. | 72/269 |
| 2176728 | 1/1987 | United Kingdom | 72/269 |

*Primary Examiner*—Lowell A. Larson
*Attorney, Agent, or Firm*—Sughrue, Mion, Zinn, Macpeak & Seas

[57] ABSTRACT

An extruding die for metallic materials comprising a male die and a female die is provided with a billet-receiving face of the male die shaped into convex form. It is possible to reduce breakage frequency of the extruding die by reducing the tensile stress applied on the male die at the time of the extrusion.

16 Claims, 11 Drawing Sheets

1
2
2a
2b
2c
3
3a
4
5
6
7
8
9
11
12

EXTRUDING DIE FOR METALLIC MATERIALS

BACKGROUND OF THE INVENTION

1. Field of The Invention

This invention relates to an extruding die used for the extrusion of metallic materials.

2. Description of the Prior Art

Heretofore, there has been extruding die which is used for the extrusion of metallic mateials having a structure as shwon in FIGS. 26 to 28 fo example.

A conventional extruding die 51 shown in the figures is a port-hole die classified into hollow dies and, has a male die 52 and a female die 53. The male die 52 is provided with a mandrel 52*a* at the top portion thereof and the female die 53 is provided with a die 53*a* in the center portion thereof. And an extruding slit 54 having the shape corresponding to a desired shape of extruded material is formed between said mandrel 52*a* and said die hole 53*a*.

A chamber 55 is formed between the male die 52 and the female die 53, and ports 57 in communication with said chamber 55 are formed at four places between four bridges 52*b* provided to the male die 52 and an outer peripheral portion 52*c* of the male die 52 connected with the female die 53 at one end face of the outer peripheral portion 52*c*. And a container 58 connected to another end face of said outer peripheral portion 52*c* of the male die 52 is so constructed as to charge a billet 59, a billet-receiving face 52*d* of the male die 52 sited on the side of the billet 59 is constructed from a flat surface.

In performing the extrusion of the billet 59 using the extruding die 51 having a structure of this kind, the billet 59 charged in the container 58 with a dummy block (not shown) placed on the backside of said billet 59 is pressed in the rightward direction in FIG. 27 by stem (not shown). Hereby, the billet 59 is pressed onto the billet-receiving face 52*d* of the male die 52, and flows in four ports 57 accompanying plastic deformation. Subsequently, the billet 59 is pressed out from the extruding slit 54 after passing through the chamber 55. And hollow extruded material is obtained, which has a desired sectional shape (which is decided against the final shape of the product considering thermal expansion and so on) corresponding to the extruding slit 54 as shown with dotted lines in FIG. 26.

However, in the conventional extruding die 51 as described above, the billet-receiving face 52*d* receives heavy pressure in the axial direction when the extrusion of the billet 59 is performed because said billet-receiving face 52*d* of the male die 52 has a flat surface as described above, and tensile stress is applied on four bridges 52*b* which hold the mandrel 52*a* of the male die 52 and form ports 57 at four places, on the side of the chamber 55 (parts shown with letters "T" in FIG. 28). Therefore, there is a problem in that a crack in said parts of the bridges 52*b* on the side of the chamber 55 is apt to develop and sometimes induces breakage of the die.

SUMMARY OF THE INVENTION

The present invention is made in view of the above mentioned problem of the prior art, it is an object to provide an extruding die for metallic materials possible to decrease breakage frequency of the extruding die by reducing the tensile stress applied on the male die of the extruding die at the time of the extrusion as little as possible in order to prevent a crack, and inhibiting the development of the crack even if the crack occurs.

The construction of the extruding die for metallic materials according to this invention for ataining the above-mentioned object is characterized by having an extruding slit in which a billet pressed onto a billet-receiving face of a male die passes through accompanying plastic deformation between a mandrel provided to said male die and a die hole provided to a female die, said billet-receiving face of the male die being shaped into convex for such as half-spherical form and polyhedral form combined with polygonal planes.

In the extruding die for metallic materials according to this invention having the aforementioned construction, the billet pressed onto the billet-receiving face shaped into convex form flows forward the extruding slit and is deformed plastically applying pressure to said billet-receiving face in the centripetal direction, and the male die is applied with compression stress caused by said pressure in the centripetal direction as described above. Consequently, the tensile stress which is produced on the chamber-side on the bridge supporting the mandrel provided to the male die of the extruding die and forming the port in which metallic materials flow is reduced or canceled, and so that occurrence and the development of a crack on the chamber-side of the bridge provided to the male die are inhibited.

DESCRIPTION OF THE PREFERRED EMBODIMENT

Embodiment 1

Figures 1, 2, 3:
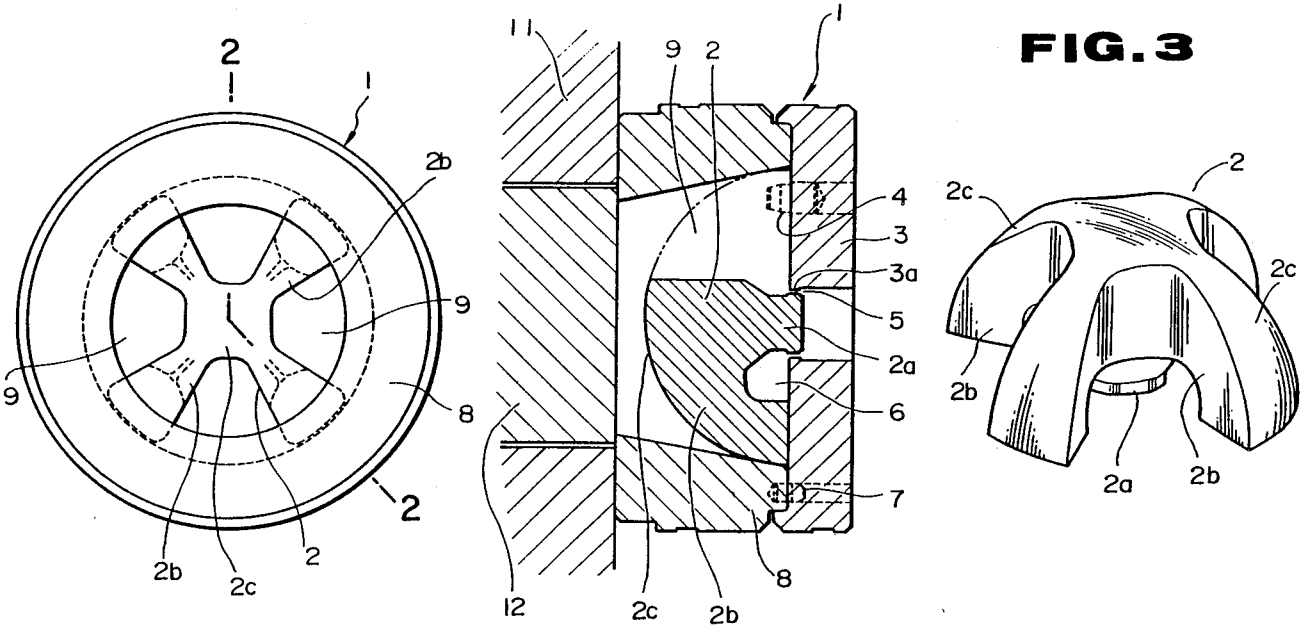
FIG. 1 is a front view from the container side illustrating the ring and male die of the extruding die for metallic materials according to the First embodiment of this invention.
FIG. 2 is a sectional view along section lines A—A shown in FIG. 1.
FIG. 3 is a perspective view illustrating the male die shown in FIG. 1.

The first embodiment of the extruding die for metallic materials according to this invention is shown in FIG. 1 to FIG. 3.

The extruding die 1 is a hollow die used for manufacturing hollow extruded material, and is provided with a male die 2 and a female die 3 holded by a back up (not shown), said male die 2 is provided with a mandrel 2*a* at top portion thereof and said female die 3 is provided a die hole 3*a* in the center portion thereof, and an extruding slit 5 having the shape corresponding to a desired shape of extruded material is formed between the meandrel 2*a* and the die hole 3*a* at the state in which the male die 2 and the female die 3 are located through a locating pin 4.

A chamber 6 is formed between the male die 2 and the female die 3, and ports 9 in communication with said chamber 6 are formed at four places between four bridges 2*b* provided to the male die 2 and the ring 8 disposed in the outer peripheral side of the male die 2 and connected with the female die 3 at the located state through a location pin 7. A container 11 connected to another end face of said ring 8 is constructed so as to loard a billet 12. Furthermore, the respective bridges 2*b* are formed into curved surfaces so that a billet-receiving face 2*c* of the male die 2 on the side of the billet 12 may be shaped into nearly half spherical-convex form on the whole, and the ring 8 is structured that its inner diameter increases gradually toward the side of the female die 3 from the side of the container 11 by shaping taperingly the inner periphery thereof.

In case the extrusion of the billet 12 is performed using the extruding die 1 having aforementioned structure, the billet 12 charged in the container 11 with a dummy block (not shown) placed on the backside thereof is pressed in the rightward direction in FIG. 2 by a stem (not shown). Hereby, the billet 12 is pressed against the billet-receiving face 2*c* of the male die 2, and flows in four ports 9 accompanying plastic deformation, subsequently the billet 12 is pressed out in the forward (directly) from the extruding slit 5 after passing through in the chamber 6. Thus, hollow extruded material having a desired scetional shape corresponding to the extruding slit 5 is obtained.

And, during said forward extrusion, the respective bridges 2*b* are formed into curved forms in order that the billet-receiving face 2*c* of the male die 2 may have a convex surface protruding toward the billet 12 on the whole, the billet 12 pressed by the stem (not shown) applies pressure on the billet-receiving face 2*c* of the male die 2 in the centripetal derection, therefore, compression stress is applied to the bridge 2*b* of the male die 2 on the side of chamber 6, so that the occurrence of a crack and its development can be inhibited.

And, the inner periphery of the ring 8 is shaped taperingly so that the inner diameter of the ring may become gradually larger toward the side of the female die 3 from the side of the container 11 (i.e. the inner periphery spreads out in the ectruding direction). therefore it is possible to decrease residual metal (billet) remaining in the male die 2 after the extrusion, and so improvement of the yield can be produced.

Furthermore, since the male die 2 and the ring 8 are constructed from separate members respectively, it is enough if only the demaged member is exchanged, and it is possible to reduce the renewal cost.

And it is possible to decrease the man-hour when the male die 2 having aforementioned structure is manufactured by casting comparing with by machining from block materials, and so it is possible to reduce the cost.

Embodiment 2

Figure 4:
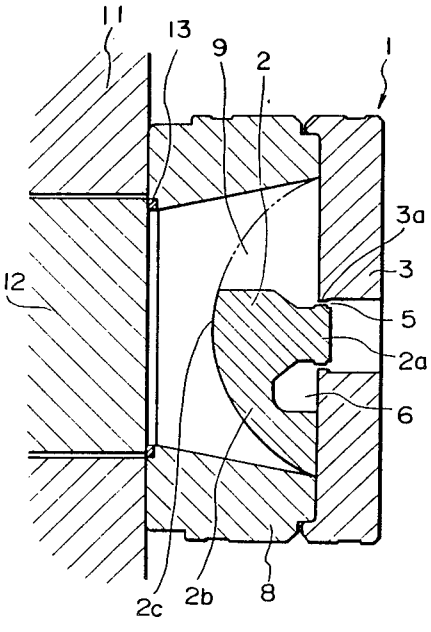

The second embodiment of the extruding die 1 according to this invention is shown in FIG. 4, in this embodiment, the respective bridge 2*b* of the male die 2 is formed into curved form in order that the billet-receiving face 2*c* of the male die 2 may be shaped into partially globular-convex form smaller than a half sphere on the whole, and the ring 8 is provided with a reinforcing ring 13 made of wear-resistant super hard metal to a billet-receiving portion thereof. In case of the extrusion, compression stress is applied to the bridge 2*b* of the male die 2 on the side of the chamber 6 even when the billet-receiving face 2*c* is shaped into the partially globular-convex form on the whole as described above, therefore it is possible to inhibite the occurrence of a crack and its development. And because the ring 8 is provided with the reinforcing ring 13 made of wear-resistant super hard metal to the billet-receiving portion thereof, it is possible to reduce the wearing by the billet 12 and it is enough if only the reinforcing ring 13 is exchanged when the reinforcing ring 13 wears out.

Embodiment 3

Figure 5:
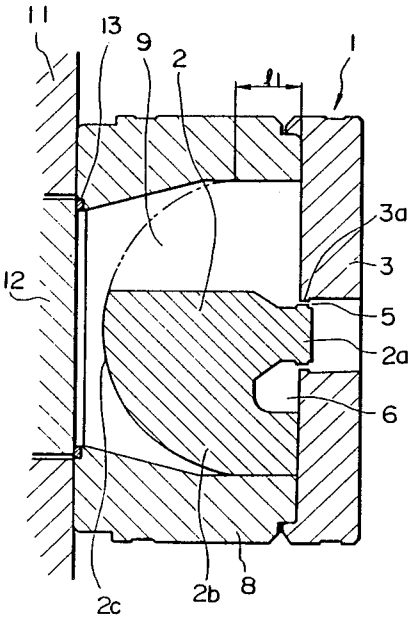

The third embodiment of the extruding die 1 according to this invention is shown in FIG. 5, in this embodiment, the respective bridge 2*b* of the male die 2 is formed into curve form in order that the billet-receiving face 2*c* of the male die 2 may be shaped into convex form comprising a nearly half spherical part and a straight cylindrical part having a length of $1_1$ on the whole. In case of the extrusion, compression stress is applied to the bridge 2*b* of the male die 2 on the side of the chamber 6 even when the billet-receiving face 2*c* is shaped into convex form comprising the half spherical part and a straight cylindrical part on the whole, therefore it is possible to inhibite the occurrence of a crack and its development.

Embodiment 4

Figure 6:
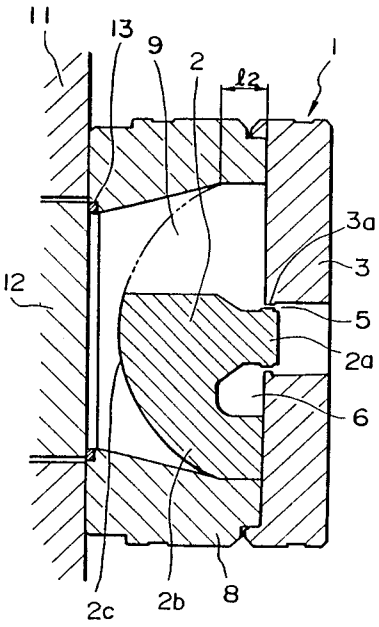
FIG. 4, FIG. 5, FIG. 6, FIG. 7 and FIG. 8 are sectional view illustrating the extruding die according to the second embodiment, third embodiment, fourth embodiment, fifth embodiment and sixth embodiment of this invention repectively.

The fourth embodiment of the extruding die 1 according to this invention is shown in FIG. 6, in this embodiment, the respective bridge 2*b* of the male die 2 is formed into curved form in order that the billet-receiving face 2*c* of the male die 2 may be shaped into convex form comprising a partially globular part smaller than a half sphere and a straight cylindrical part having a lenght of $1_2$ on the whole. Because compression stress is applied to the bridge 2*b* of the male die 2 on the side of the chamber 6 at the time of the extrusion even when the billet-receiving face 2*c* is shaped into convex form having the partially globular part and a straight cylindrical part on the whole, it is possible to inhibite the occurrence of a crack and its development.

Embodiment 5

Figure 7:
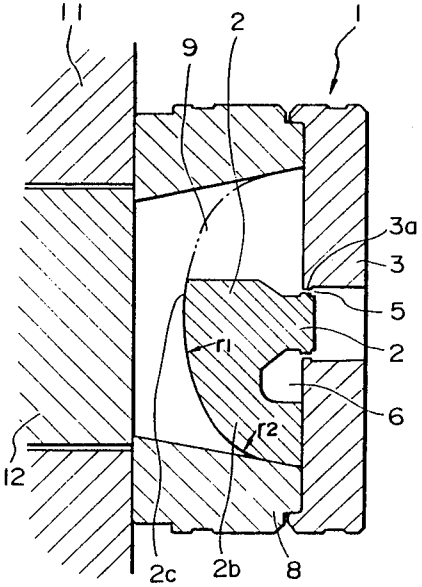

The fifth embodiment of the extruding die 1 according to this invention is shown in FIG. 7, in this embodiment, the respective bridge 2*b* of the male die 2 is formed into curved form in order that the billet-receiving face 2*c* of the male die 2 may be shaped into convex form comprising a part having the radius of curvature of $r_1$ and a part having the different radius of curvature of $r_2$ on the whole. In case of the extrusion, compression stress is applied to the brigde 2*b* of the male die 2 on the side of the chamber 6 even when the billet-receiving face 2*c* has the convex form having two or more radii differing from each other, therefore it is possible to inhibite the occurrence of a crack and its development, and it is possible to reduce the cost of the die and to facilitate the handling of the die because the male die 2 has a small volume as compared with that of the first embodiment and the weight of the die decreases.

Embodiment 6

Figure 9:
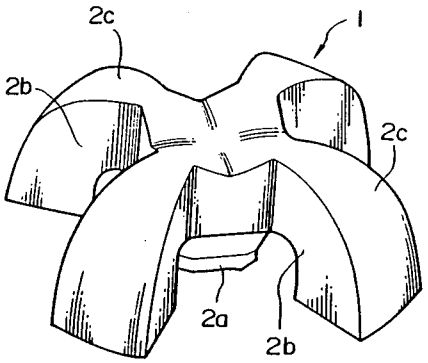
FIG. 9 is a perspective view illustrating the male die shown in FIG. 8.
Figure 8:
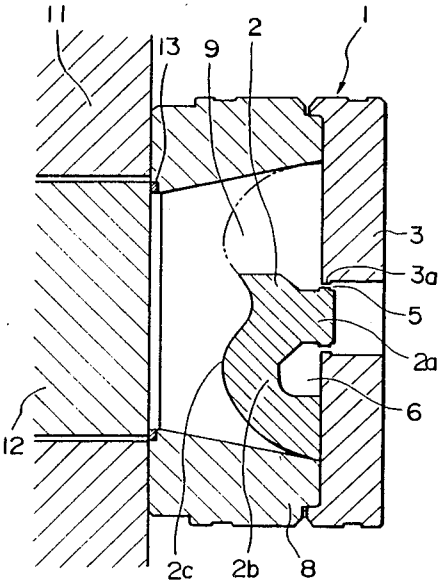

The sixth embodiment of the extruding die 1 according to this invention is shown in FIG. 8 and FIG. 9, in this embodiment, the respective bridge 2*b* is formed into convex form on the side of the billet-receiving face in order that the billet-receiving face 2*c* of the male die 2 may shaped into convex form protruding to the side of the billet 12 as a whole and sunken in the center portion. Because compression stress is applied to the bridge 2*b* of the male die 2 on the side of the chamber 6 at the time of the extrusion even when the billet-receiving face 2*c* is shaped into convex form protruding to the side of the billet 12 as a whole and depressed in the center portion, it is possible to inhibite the occurrence of a crack and its development, And it is possible to reduce the cost of the die and to facilitate the handling of the die because the male die 2 has a small volume as compared with that of the first embodiment and the weight of the die decreases.

Embodiment 7

Figure 10:
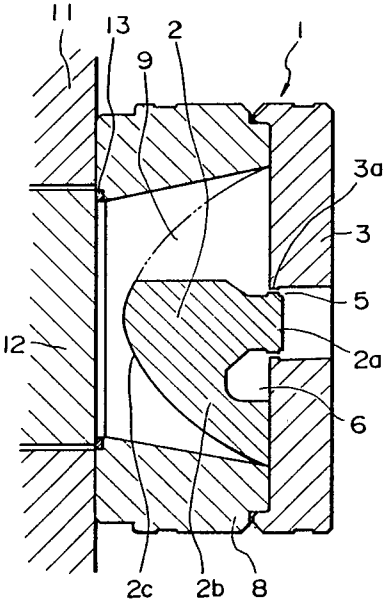

The 7th embodiment of the extruding die 1 according to this invention is shown in FIG. 10, in this embodiment, the respective bridge 2*b* is formed into curved form in order that the billet-receiving face 2*c* of the male die 2 may be shaped into partially hyperboloidal-convex form or partially paraboloidal-convex form on the whole. At the time of the ectrusion, compression stress in applied to the bridge 2*b* of the male die 2 on the side of the chamber 6 even when the billet-receiving face 2*c* is shaped into partially hyperboloidal-convex form or partially paraboloidal-convex form on the whole, therefore it is possible to inhibite the occurrence of a crack and its development.

Embodiment 8

Figure 11:
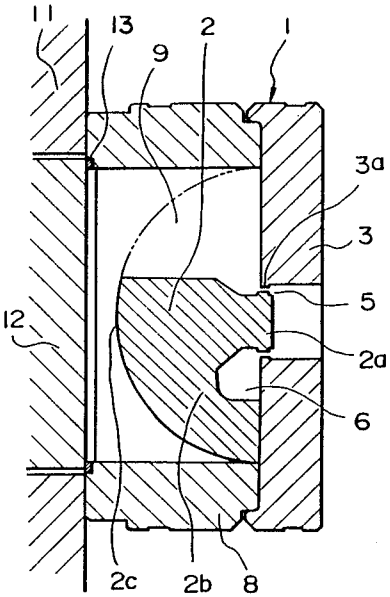
FIG. 10 and FIG. 11 are sectional view illustrating the extruding die according to the 7th and 8th embodiments of this invention respectively.

The 8th embodiment of the extruding die 1 according to this invention is shown in FIG. 11, in this embodiment, the respective bridge 2*b* is formed into curved form in order that the billet-receiving face 2*c* of the male die 2 may be shaped into nearly half spherical-convex form on the whole. And ring 8 is formed into a straight cylindrical shaped having the same inner diameter in the axial direction. Also in this case, it is possible to inhibite the occurrence of a crack and its development because compression stress in applied to the bridge 2*b* of the male die 2 on the side of the chamber 6 at time of extrusion. Accordingly, this invention is not restricted in case the inner periphery of the ring 8 is formed taperingly as shown in the previous embodiment.

Embodiment 9

Figure 12:
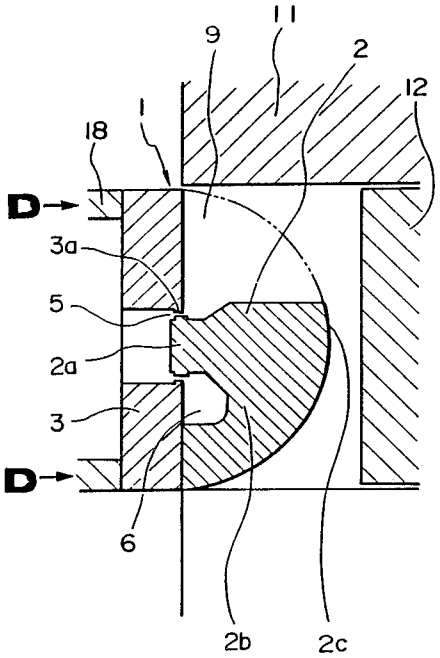
FIG. 12 is a sectional view illustrating procedures of the indirect extruding using the extruding die for metallic materials according to the 9th embodiment of this invention.

The 9th embodiment of the extruding die 1 according to this invention is shown in FIG. 12, although cases of the direct extrusion (forward extrusion) were explained in aforementioned embodiments (embodiment 1 to 8), a case of the indirect extrusion (backward extrusion) is shown in this embodiment. The extruding die 1 is so structured that the extruding slit 5 is formed by combining the male die 2 provided with the mandrel 2*a* and formed into curved form at the respective bridge 2*b* in order that the billet-receiving face 2*c* may be shaped into nearly half spherical-convex form as a whole, with the female die 3 provided with the die hole 3*a*, and it has the same structure as the case of the first embodiment described above. However, the female die 3 is connected with a stem 18 and the male die 2 is so structured as to move with said female die 3, in this regard it is different from the case of the first embodiment.

In performing the extrusion of the billet 12 using the extruding die 1 having such a structure, the male die 2 is moved by the stem 18 together with the female die 3 in the rightward direction in FIG. 12 (in the direction of the arrow D) after charging the billet 12 in the container 11. The billet 12 is pressed against the billet-receiving face 2*c* of the male die 2 by this movement, and flows in four ports 9 accompanying plastic deformation, subsequently, the billet 12 is pressed out in the backward (indirectly) from the extruding slit 5 after passing through in the chamber 6. Thereby, hollow extruded material having a prescribed sectional shape corresponding to the shape of the extruding slit 5 is obtained.

And, also during said backward extrusion, because the billet-receiving face 2*c* of the male die 2 is shaped into convex form protruding toward the billet 12 on the whole, the billet 12 pressed indirectly by the stem 18 applies pressure on the billet-receiving face 2*c* of the male die 2 in the centripetal direction, compression stress is applied to the bridge 2*b* of the male die 2 on the side of the chamber 6, therefore the occurrence of a crack and its development can be inhibited. Hereupon, the shape of the billet-receiving face 2*c* of the male die 2 is not limited to such a shape having half spherical-convex form as shown in FIG. 12, the male die 2 may be ecchanged properly with the male die having the partially globular form smaller than a half sphere and the partially straight cylindrical form, or the sunken form in the center portion as examplified in FIG. 4 to FIG. 10, furthermore it may be exchanged with another one combined with said forms.

Embodiment 10

Figure 15:
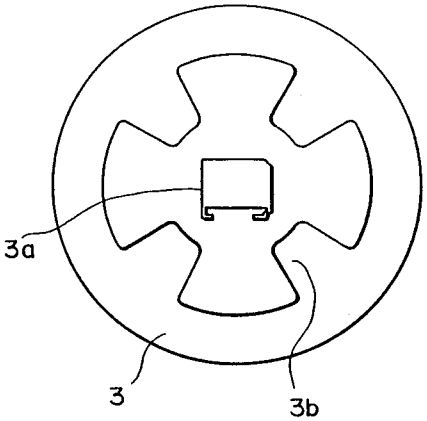
FIG. 15 is a front view illustrating the female die shown in FIG. 13.
Figure 14:
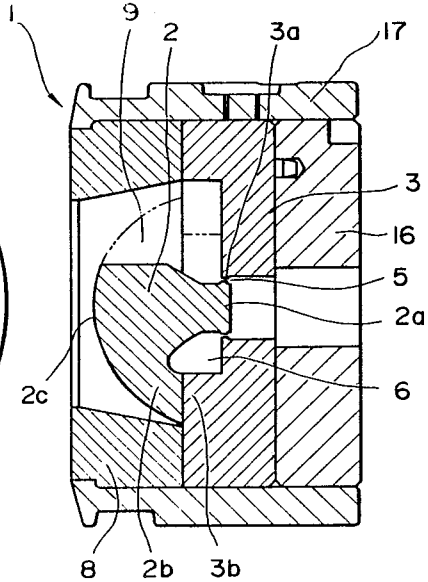
FIG. 14 is a sectional view along section lines B—B shown in FIG. 13.
Figure 13:
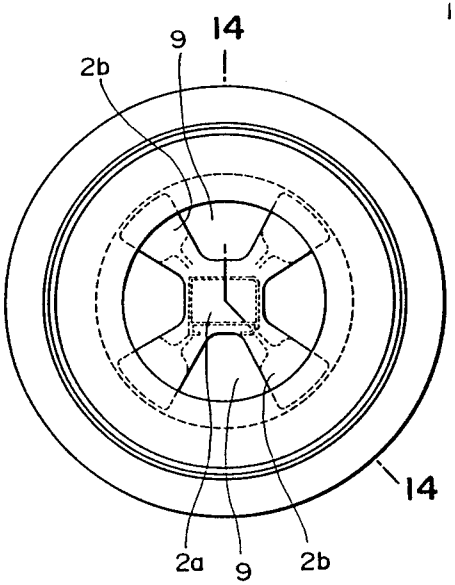
FIG. 13 is a front view from the ring side illustrating the extruding die for metallic materials according to the 10th embodiment of this invention.

The 10th embodiment of the extruding die for metallic materials according to this invention is shown in FIG. 13 to FIG. 15, in the extruding die 1 of this embodiment, legs of four bridges 2*b* provided to the male die 2 of the extruding die 1 according to the first embodiment shown in FIG. 1 and FIG. 3 are shortened and the female die 3 is provided with leg-receivers 3*b* having the thickness corresponding to the shortened length of said leg at four places as shown in FIG. 15. And the male die 2 and the female die 3 are connected at the position of said leg-receiver 3*b* and the ring 8, the female die 3 and a backer 16 are held in a casing 17 unitedly.

Also in this embodiment, compression stress is applied to the bridge 2*b* of the male die 2 on the side of the chamber 6 at the fime of extrusion, therefore, it is possible to inhibite the occurrence of a crack and its development, and it is possible to improve the strength of the male die 2 because legs of the four bridges 2*b* provided to the male die 2 is shortened.

Embodiment 11

Figure 17:
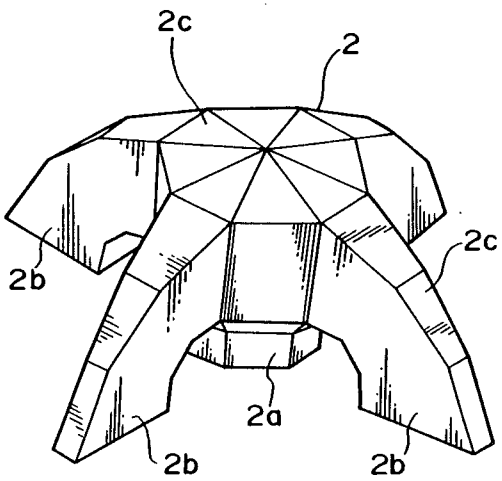
FIG. 17 is a perspective view illustrating the male die shown in FIG. 17.
Figure 16:
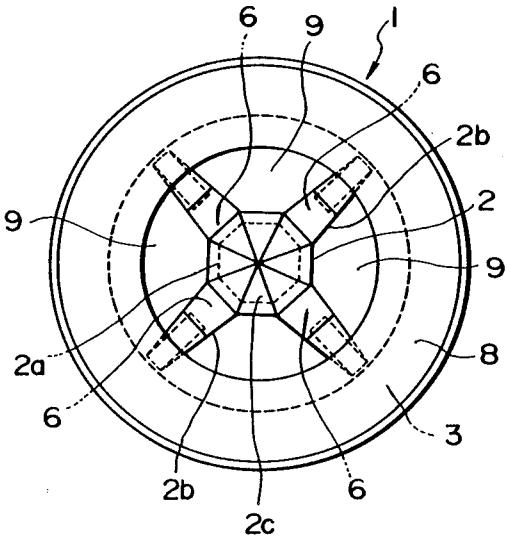
FIG. 16 is a front view from the container side illustrating the ring and the male die of the extruding die for metallic materials according to the 11th embodiment of this invention.

The 11th embodiment of the extruding die for metallic materials according to this invention is shown in FIG. 16 to FIG. 17, in the extruding die 1 of this embodiment, top portion of the billet-receiving face 2*c* of the male die 2 is formed into a parasol-like shape by combining some triangular planes and the respective bridge 2*b* is formed into crooked shape having some flat surfaces in order that the billet-receiving face 2*c* may be shaped into polyhedral-convex form on the whole. And the respective bridge 2*b* is so formed as to reduce gradually its width in the circumferntial direction toward the end part outwardly.

Thus, it is possible to inhibite the occurrence of a crack and its development because compression stress is applied to the bridge 2*b* of the male die 2 on the side of the chamber 6 even when the billet-receiving face 2*c* is shaped into polyhedral-convex form as a whole by combining polyganal planes (triangular planes and square planes).

And because the width in the circumferential direction of the bridge 2*b* because gradually narrower toward the end part of the bridge 2*b* outwardly and the volume of the respective port 9 is large as compared with that of the first embodiment, the billet flows in the port 9 more smoothly at the time of the extrusion. In addition to above, it is possible to reduce the cost of the die and to facilitate the handling of the die because the male die 2 has a small volume as compared with that of the first embodiment and the weight of the die decreases.

Embodiment 12

Figure 19:
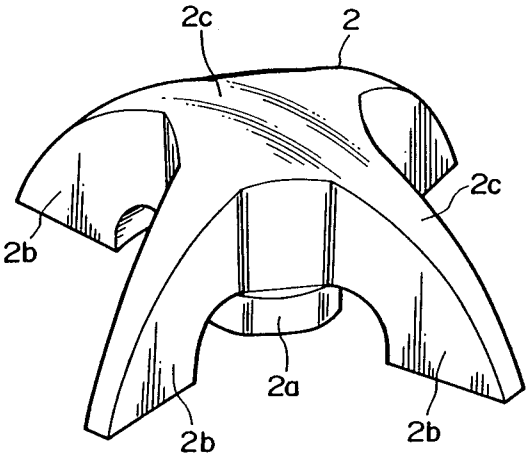
FIG. 19 is a perspective view illustrating the male die shown in FIG. 18.
Figure 18:
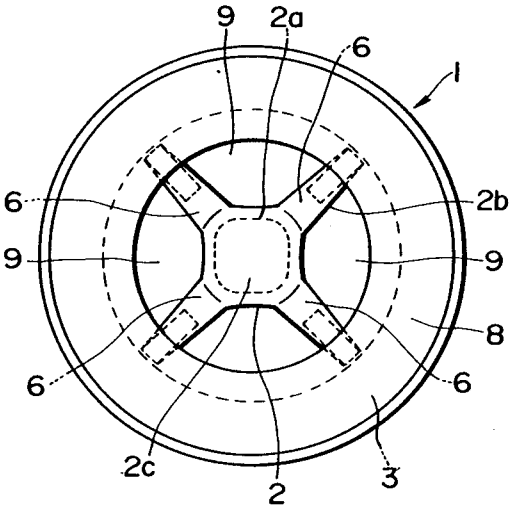
FIG. 18 is a front view from the container side illustrating the ring and the male die of the extruding die for metallic materials according to the 12th embodiment of this invention.

The 12th embodiment of the extruding die for metallic materials according to this invention is shown in FIG. 18 and FIG. 19, in the extruding die 1 of this embodiment, four bridges 2*b* provided to the male die 2 of the extruding die 1 of the first embodiment shown in FIG. 1 to FIG. 3 are so structured that the widths in the circumferential direction of the bridges 2*b* becomes gradually narrower toward the end parts thereof outwardly.

Also in this embodiment, compression stress is applied to the bridge 2*b* of the male die 2 on the side of the chamber 6 in case of the extrusion, therefore, it is possible to inhibit the occurrence of a crack and its development at this position.

And because the width in the circumferential direction of the bridge 2*b* becomes gradually narrower toward the end part outwardly and the volume of the respective port 9 is large as compared with that of the first embodiment, the billet flows in the port 9 more smoothly at the time of the extrusion. And it is possible to reduce the cost of the die and to facilitate the handling of the die because the male die 2 has a small volume as compared with the case of the first embodiment and the weight of the die decreases.

Embodiment 13

Figure 21:
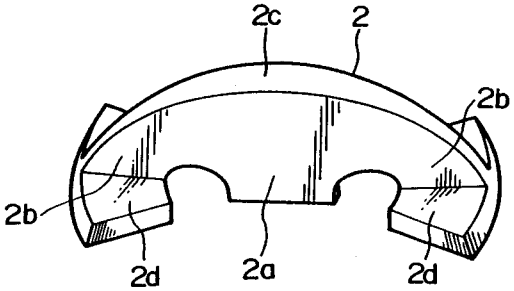
FIG. 21 is a perspective view illustrating the male die shown in FIG. 20.
Figure 20:
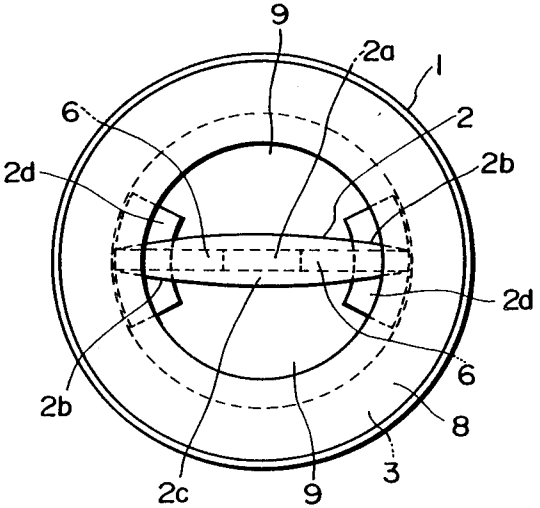
FIG. 20 is a front view from the container side illustrating the ring and the male die of the extruding die for metallic materials according to the 13th embodiment of this invention.

The 13th embodiment of the extruding die for metallic materials according to this invention is shown in FIG. 20 and FIG. 21, the extruding die 1 of this embodiment is provided with two bridges 2*b* to the male die 2, the respective bridges 2*b* are formed into curved form so that the billet-receiving face 2*c* may be shaped into nearly arched-convex form as a whole, and the respective bridge 2*b* in formed so as to reduce the width in the circumferential direction thereof toward the end part outwardly and is provided with a flange 2*d* along the circumferential direction on the both sides of said end part thereof.

In case the extrusion of the billet is performed using the extruding die 1 having afore-mentioned structure, the billet pressed by the stem (not shown) is pressed against the billet-receiving face 2*c* of the male die 2 and flows in two ports 9 accompanying plastic deformation, subsequently the billet is pressed out from the extruding slit after passing through in the chamber 6. In this manner, hollow extruded material having a desired section corresponding to the shape of the extruding slit is obtained.

And also in this embodiment, because compression stress is applied to the bridge 2*b* of the male die 2 on the side of the chamber 6, it is possible to inhibit the occurrence of a crack and its development at this position.

As the male die 2 has two bridges 2*b* and is so formed that the width in the circumferential direction of said bridge 2*b* becomes gradually narrower toward the end part, the volume of two ports 9 is fully large as compared with the case of the first embodiment and the billet flows in these ports 9 more smoothly of the time of the extrusion. And it is possible to reduce the cost of the die and to facilitate the handling of the die because the male die 2 has a small volume and the weight decreases.

Furthermore, if the billet goes into the die hole unevently, at the time of the extrusion, the mandrel 2*a* of the male die 2 receives the force in the virtial direction in FIG. 20. However, the bridge 2*b* can support said mandrel 2*a* stably though its width is narrowed down, because said bridge 2*b* is provided with the flange 2*d* to the end part of the bridge 2*b*. In addition to above, it is possible to obtain the sufficient interconnecting strength if the male die 2 and the female die 3 are connected each other by screwing bolts passed through the female die 3 into said flanges 2*d*.

And the respective flanges 2*d* provided to the end parts of the two bridges 2*b* are not always necessary to be provided protrudingly on the both sides from the end parts of the bridges 2b, they may be provided respectively on the either sides which are rotational-symmetric with each other from the end parts of the two bridges 2b.

Embodiment 14

Figure 23:
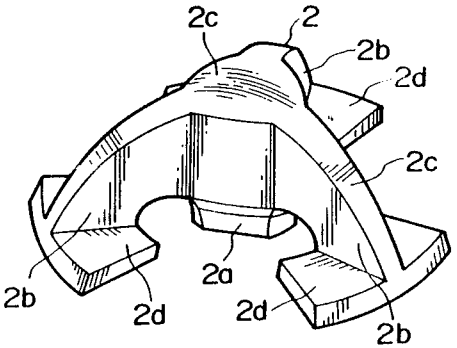
FIG. 23 is a perspective view illustrating the male die shown in FIG. 22.
Figure 22:
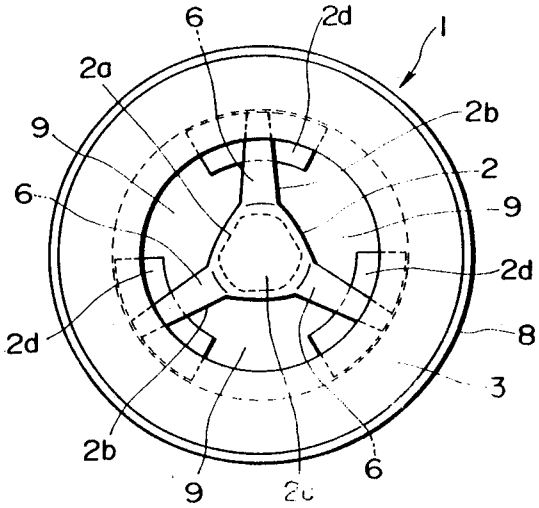
FIG. 22 is a front view from the container side illustrating the ring and the male die of the extruding die for metallic materials according to the 14th embodiment of this invention.

The 14th embodiment of the extruding die for metallic materials according to this invention is shown in FIG. 22 and FIG. 23, the extruding die 1 of this embodiment is provided with the bridges 2b brovided to the male die 2 of the extruding die 1 of the 13th embodiment shown in FIG. 20 and FIG. 21 at three places on the male die 2, and disposed with respective bridges 2b at almost equal interval so as to shape the billet-receiving face 2c into half spherical -convex form on the whole.

Also in this embodiment, it is possible to inhibite the occurrence of a crack and its development because compression stress is applied to the bridge 2b of the male die 2 on the side of the chamber 6.

As the male die 2 has three bridges 2b and is so formed that the width in the circumferential direction of said bridge 2b becomes gradually narrower toward the end part, the volume of the ports 9 becomes large and the billet flows in these parts 9 more smoothly at the time of the extrusion, and it is possible to reduce the cost of the die and to facilitate the handling of the die because the volume of the male die 2 becomes small and the weight decreases.

Furthermore, because three bridges 2b are provided with the flanges 2d to the end parts thereof respectively, said brings 2b can support the mandrel 2a stably through its width is narrowed down, and it is possible to obtain the sufficient interconnecting strength if the male die 2 and the female die 3 are connected each other by screwing bolts passed through the female die 3 into the flanges 2d.

Embodiment 15

Figure 25:
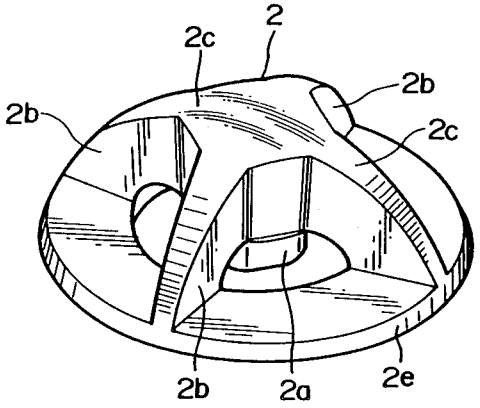
FIG. 25 is a perspective view illustrating the male die shown in FIG. 24.
Figure 24:
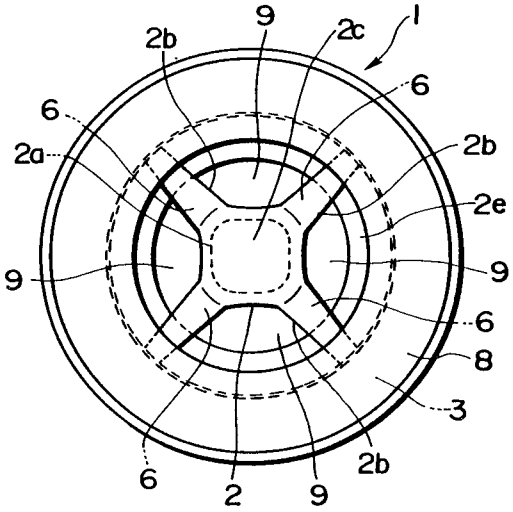
FIG. 24 is a front view from the container side illustrating the ring and the male die of the extruding die of metallic materials according to the 15th embodiment of this invention.
Figure 28:
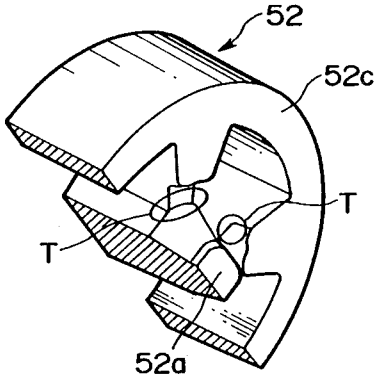
FIG. 28 (PRIOR ART)
FIG. 28 is a vertically sectional perspective view illustrating the male die shown in FIG. 26.
Figure 27:
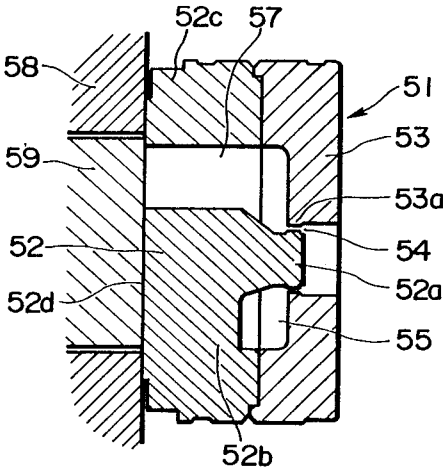
FIG. 27 (PRIOR ART)
FIG. 27 is a sectional view along section lines C—C shown in FIG. 26.
Figure 26:
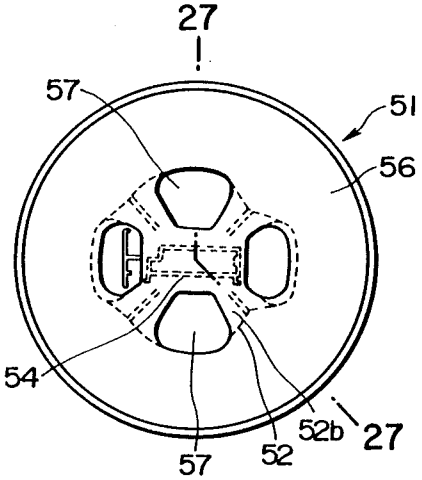
FIG. 26 (PRIOR ART)
FIG. 26 is a front view from the container side illustrating the conventional extruding die for metallic materials.

The 15th embodiment of the extruding die for metallic materials according to this invention is shown in FIG. 24 and FIG. 25, in the extrusion die 1 of this embodiment, the respective end parts of four bridges 2b provided to the male die 2 of the extruding die 1 of the 12th embodiment shown in FIG. 18 and FIG. 19 are connected with a ringshaped flange 2e.

Also in this embodiment, because compression stress is applied to the bridge 2b of the male die on the side of the chamber 6, it is possible to inhibit the occurrence of a crack and its development at this position.

Although the extruding die 1 of this embodiment is inferior to that of the 12th embodiment in the cost and the handling facility of the die because the end parts of the bridges 2b are connected with the ringshaped flange 2e, it is possible to support the mandrel 2a under more stable contision. In addition to above, if the male die 2 and the female die 3 are connected each other by screwing bolts passed through the femal die 3 into said ringshaped flange 2e, it is possible to connect the both dies firmly.

And though the male dies 2 having two to four bridges 2b were shown in aforementioned respective embodiment, the male die used in this invention is not limited to such a type, the male die having bridges more than four may be also used for this invention.

Furthermore, the sectional shape of the bridge 2b of the male die used in this invention is not limited to the shape as shown in the respective embodiments.

As mentioned above, the extruding die for metallic materials according to this invention has an extruding slit in which a billet pressed onto a billet-receiving face of a male die passes through accompanying plastic deformation between a mandrel provided to said male die and a die hole povided to a female die, and said billet-receiving face of the male die is shaped into convex form. Therefore an excellent effect is obtained that it is possible to inhibite the occurrence of a crack and its development and to contribute to the improvement of productivity by decreasing the breakage frequency of the die because the extruding die is prevented from the applying of tensile stress at the extrusion, and especially. Tensile stress produced at the bridge on the side of chamber is reduced or canceled. Furthermore, in the extruding die according to this invention, it is possible to improve the strength of the die considerably as compared with the conventional extruding die when the distance from the mandrel of the male die to the billet-receiving face is the same as that of the conventional one, and so it is possible to reduce the volume of the die when the strength of the extruding die according to this invention is coordinated with that of the conventional one. Accordingly, another excellent effect is obtained that it is possible to miniaturize the male die and to facilitate the handling of the die.

What is claimed is:

1. An extruding die for metallic materials comprising:

a female die having a die hole extending therethrough and a man die having a mandrel extending into said die hole with clearance to define an extrusion slit between said mandrel and said die hole, a plurality of spaced apart bridges connected to said mandrel with end portions engaging said female die and a convex billet-receiving face on a side thereof remote from said female die, wherein said bridges each have a decreasing width in the circumferential direction from said mandrel to said end portions.

2. An extruding die for metallic materials as set forth in claim 1, wherein said billet-receiving face of the male die is shaped into convex form at every bridge provided on said male die.

3. An extruding die for metallic materials as set forth in claim 1, wherein said billet-receiving face of the male die is shaped into nearly half spherical-convex form.

4. An extruding die for metallic materials as set forth in claim 1, wherein said billet-receiving face of the male die is shaped into partially globular-convex form smaller than a half sphere.

5. An extruding die for metallic materials as set forth in claim 1, wherein said billet-receiving face of the male die is shaped into convex form comprising a nearly half spherical part and a straight cylindrical part.

6. An extruding die for metallic material as set forth in claim 1, wherein said billet-receiving face of the male die is shaped into convex form comprising a partially globular part smaller than a half sphere and a straight cylindrical part.

7. An extruding die for metallic materials as set forth in claim 1, wherein said billet-receiving face of the male die is shaped into convex form comprising two or more parts having different radii of curvature.

8. An extruding die for metallic materials as set forth in claim 1, wherein said billet-receiving face of the male die is shaped into convex form sunken in the center portion.

9. An extruding die for metallic materials as set forth in claim 1, wherein said billet-receiving face of the male die is shaped into hyperboloidal convex-form.

10. An extruding die for metallic materials as set forth claim 1, wherein said billet-receiving face of the male die is shaped into paraboloidal-convex form.

11. An extruding die for metallic materials as set forth in claim 1, wherein said billet-receiving face of the male die is shaped into polyhedral-convex form.

12. An extruding die for metallic materials as set forth in claim 1, wherein said male die is provided with four bridges.

13. An extruding die for metallic materials as set forth in claim 1, wherein said male die is provided with three bridges.

14. An extruding die for metallic materials as set forth in claim 1, wherein said male die is provided with two bridges.

15. An extruding die for metallic materials as set forth in claim 1, wherein said bridges of the male die are provided with flanges on the end portions respectively.

16. An extruding die for metallic materials as set forth in claim 1, wherein the male die is provided with a ringshaped flange connecting the end portions of said bridges.

* * * * *